US011363698B2

(12) United States Patent
Brown

(10) Patent No.: US 11,363,698 B2
(45) Date of Patent: Jun. 14, 2022

(54) DOOR HARDWARE ILLUMINATION DEVICE

(71) Applicant: Mary Ellen Brown, Chicago, IL (US)

(72) Inventor: Mary Ellen Brown, Chicago, IL (US)

( * ) Notice: Subject to any disclaimer, the term of this patent is extended or adjusted under 35 U.S.C. 154(b) by 0 days.

(21) Appl. No.: 17/218,327

(22) Filed: Mar. 31, 2021

(65) Prior Publication Data

US 2021/0321503 A1 Oct. 14, 2021

Related U.S. Application Data

(60) Provisional application No. 63/009,469, filed on Apr. 14, 2020.

(51) Int. Cl.

| | |
|---|---|
| ***H05B 47/115*** | (2020.01) |
| ***H05B 47/19*** | (2020.01) |
| ***F21L 4/08*** | (2006.01) |
| ***F21V 33/00*** | (2006.01) |
| ***F21S 4/22*** | (2016.01) |
| ***H05B 47/17*** | (2020.01) |
| ***F21Y 115/10*** | (2016.01) |

(52) U.S. Cl.

CPC ..... *H05B 47/115* (2020.01); *F21L 4/08* (2013.01); *F21S 4/22* (2016.01); *F21V 33/006* (2013.01); *H05B 47/19* (2020.01); *F21Y 2115/10* (2016.08); *H05B 47/17* (2020.01)

(58) Field of Classification Search

CPC ..... H05B 47/115; H05B 47/19; H05B 47/17; F21L 4/08; F21S 4/22; F21V 33/006; F21Y 2115/10; Y02B 20/40

See application file for complete search history.

(56) References Cited

U.S. PATENT DOCUMENTS

| | | | | |
|---|---|---|---|---|
| 6,447,139 | B1 * | 9/2002 | Wilkes | E05B 17/10 362/802 |
| 6,461,013 | B1 * | 10/2002 | Simon | E05B 17/10 362/100 |
| 10,151,122 | B2 * | 12/2018 | Marks | E05B 17/10 |
| 10,352,512 | B1 * | 7/2019 | Smith | F21V 23/0464 |
| 10,794,082 | B1 * | 10/2020 | Watson | E05B 1/0084 |
| 2009/0122522 | A1 * | 5/2009 | Yang | E05B 1/0007 362/100 |

(Continued)

FOREIGN PATENT DOCUMENTS

| | | | | |
|---|---|---|---|---|
| GB | 2481288 A | * | 12/2011 | F21L 4/08 |
| WO | WO-2009056765 A2 | * | 5/2009 | A61L 2/10 |

*Primary Examiner* — Renan Luque

(74) *Attorney, Agent, or Firm* — Brennan, Manna & Diamond, LLC

(57) ABSTRACT

This present invention relates to an illuminated source of light used for illuminating specific areas, such as door handles, door locks, door knobs and more. The source of light comprises an integrated light source, such as a plurality of LED lights, that can be turned ON manually or automatically based on motion detection of an approaching individual or object. Additionally, the source of light may be automatically turned OFF after a predetermined duration of time has elapsed in order to conserve battery life. The illuminated source of light offers a functional and decorative lighting solution for illuminating dark or dimly lit areas, such as dwelling entries.

15 Claims, 4 Drawing Sheets

(56) References Cited

U.S. PATENT DOCUMENTS

| | | | | |
|---|---|---|---|---|
| 2012/0200227 | A1* | 8/2012 | Nasiatka | F21V 15/01 315/159 |
| 2015/0377478 | A1* | 12/2015 | Yang | F21S 9/02 362/191 |
| 2017/0122506 | A1* | 5/2017 | Collins | G08B 5/004 |
| 2018/0142500 | A1* | 5/2018 | Shintani | E05B 41/00 |
| 2019/0024409 | A1* | 1/2019 | Thomen | F21V 23/0464 |

* cited by examiner

DOOR HARDWARE ILLUMINATION DEVICE

CROSS-REFERENCE TO RELATED APPLICATION

The present application claims priority to, and the benefit of, U.S. Provisional Application No. 63/009,469, which was filed on Apr. 14, 2020 and is incorporated herein by reference in its entirety.

FIELD OF THE INVENTION

The present invention relates generally to the field of illuminating devices. More specifically, the present invention relates to an illuminated source of light that is designed to be attached to a door knob, a deadbolt or a door handle. The illuminated source of light can be positioned to illuminate directly at or around the deadbolt, door handle, or other hardware. The illuminated source of light offers a steady glow of light around the door hardware as an individual approaches the door, thereby illuminating dimly lit or dark areas. The illuminated source of light of the present invention provides users with a source of light in various shapes with an integrated light source, including light emitting diode (LED) lights with various amounts of lumens and bulb colors. The device ensures that an illuminated light source is always available when needed. Additionally, the illuminated source of light can be turned "ON" automatically, or with minimum effort. Accordingly, the present disclosure makes specific reference thereto. Nonetheless, it is to be appreciated that aspects of the present invention are also equally applicable to other like applications, devices and methods of manufacture.

BACKGROUND OF THE INVENTION

By way of background, various light sources, such as nightlights, accent lighting and other light devices, are available in the market and are used around the world to illuminate dark or dimly lit areas. In several dwelling areas, it can be hard to find a light source when an individual needs it. For example, people may often need a source of light when entering a house, searching for a key, inserting a key into a door knob or dead bolt lock, finding a light switch or outlet, or in other similar situations. Without proper lighting in dark or dimly lit areas, individuals, both adults and children, may feel nervous, scared or rush to quickly enter a house or an apartment. Darkness creates additional pressure to quickly find a key and open the door, which can cause anxiety and nervousness amongst individuals.

Conventional lamps or nightlights are designed to be placed on a table or affixed to a wall to provide a light source in a room. These lights provide indirect lighting and might offer a broad light source that oftentimes is ineffective for a person attempting to see to access a dwelling. In such situations, the individual can no longer see the door handle and/or lock to open or unlock the door, which is an inconvenience to the user. Additionally, such light sources oftentimes need to be manually turned ON/OFF using light switches or outlets. When an individual walks into a dark room at night, it may be difficult to locate light switches or outlets to turn ON the light. In dark and dimly lit surroundings, individuals, and particularly children, may feel nervous or anxious, or may risk injury if unable to see properly, causing additional inconvenience and discomfort.

Other kinds of lights are also available in the market, but none of the same offer direct lighting to a specific targeted area such as a door handle and/or lock in an entry way. To provide direct lighting for unlocking a door, a light source can be attached to a wall opposite from the door. However, when an individual stands in front of a door to access the handle and/or lock, the light source may be blocked and a shadow may be created on the door, thereby causing a problem in viewing the door handle or knob to unlock the door.

Therefore, there exists a long felt need in the art for an improved illuminated lighting source that provides light in dwelling areas by illuminating dark and dimly lit areas. There is a long felt need in the art for an illuminated source of light for providing focused lighting on specific areas, such as door knobs, door handles, door locks and more. Moreover, there is a long felt need in the art for an illuminated source of light that ensures the door handle or door lock is easily accessible by users in dark or dimly lit surroundings, creating a sense of relief and security amongst individuals, particularly children, when attempting to access a dwelling or enter a dark room. Furthermore, there is a long felt need in the art for an illuminated source of light that does not require the user to find a light switch or outlet to access a door. Additionally, there is a long felt need in the art for a light source that provides direct lighting for door handles, door knobs, door locks and more without being blocked by the individual accessing the door. Finally, there is a long felt need in the art for an illuminated source of light that focuses light directly on door handles, door knobs, door locks or other specific areas, is decorative in design and that is relatively inexpensive to manufacture.

The subject matter disclosed and claimed herein, in one embodiment thereof, comprises a "smart" illuminating light device designed to offer a targeted beam of light. The device is comprised of a main body having a groove in which a light source is placed, a motion sensor, a rechargeable battery to provide power to the motion sensor and the light source, a transparent, translucent or semi-opaque sheath to cover the light source and an attachment mechanism at the bottom of the main body to adhere the smart illuminating light device to any surface. The device provides both direct and indirect illumination. The motion sensor detects a motion/movement within a range and the light source is automatically turned on. A timer circuit, with a pre-configured timer value, allows the light source to automatically turn off after the timer value has expired.

In this manner, the novel illuminated source of light of the present invention accomplishes all of the forgoing objectives, and provides a convenient and effective solution to illuminate specific areas such as door handles, door knobs and/or door locks. The illuminated source of light of the present invention is also user friendly, inasmuch as it illuminates dark or dimly lit areas without requiring and does not require the user to put much effort in turning ON the light source. The illuminated source of light is not only convenient to use but is also aesthetically appealing.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a smart illuminating light device designed to offer a steady glow of light. The device is comprised of a main body having a groove in which a light source is placed, a motion sensor, a rechargeable battery to provide power to the motion sensor and the light source, a transparent sheath to cover the light source and adhesive tape at the bottom of the main body to adhere the smart illuminating light device to any surface. The light source selectively provides direct and indirect illumination to the desired area. The motion sensor detects a motion or movement within a certain range and the light source is automatically turned ON. A timer circuit, with a pre-configured timer value, allows the light source to automatically turn OFF after said timer value has expired.

In a further embodiment of the present invention, a smart illuminating light device for door handles, door locks and deadbolts is disclosed and comprises an LED light source; a rechargeable Li-Ion battery, a micro-USB charging port, a PCB assembly or controller having a processor and a timer circuit, a motion sensor, and a wireless module. The motion sensor enables the LED light source to turn ON after detecting a movement within a predetermined range. The timer circuit automatically turns OFF the LED lights after a predetermined time value has expired. The wireless module establishes a wireless connection between the illuminating device and a smartphone or other smart device such as a tablet. The processor controls the operation of the components by giving instructions for operation of the illuminating device. The micro-USB charging port is used for charging the rechargeable battery.

In a further embodiment of the present invention, an illuminating device for door knobs is disclosed and comprises a top clear polycarbonate layer. The polycarbonate layer covers an underlying light source. The light source is present within a groove along the circumference of the main body, wherein the groove is formed between an exterior surface and an interior surface of the main body. The main body has a layered structure wherein each layer is connected to the next through a Neodymium magnet. Adhesive tape at the bottom of the lowest layer of the main body can be used to attach to, for example, a door surface. The illuminating device has a motion sensor, a timing circuit and a battery disposed between the top layer of the main body and the layer containing the light source.

In yet a further embodiment of the present invention, an illuminating device configured to provide illumination to a desired area is disclosed and comprises an LED illuminating source, a wireless module to provide wireless connection to an electronic device, a motion sensor to detect movement in a vicinity of the illuminating device, a timer circuit to turn OFF the LED light source, a rechargeable battery to provide energy to the LED light source and a motion sensor. The light source can be controlled by a smartphone application installed on a paired smartphone or tablet. The light source can provide a selectively uniform or non-uniform illumination in a desired area for user convenience and security.

The illuminating device of the present invention can be configured to provide illumination only when motion is detected within an area in which the illuminating light has been installed, thereby providing users with a small amount of illumination to light the desired area should the user awaken in the middle of the night. The device does not provide continuous illumination that could interfere with sleeping if installed, for example, in a bedroom. The illuminating device provides easier egress from, and ingress into, a room during dark hours. The device can be attached to a refrigerator, oven or any other appliance in a kitchen to facilitate a user's ability to navigate the area conveniently and safely in dark or dimly lit conditions.

The light source of the device can be programmed to automatically turn on when motion is detected. The light source can illuminate directly around a deadbolt or door handle, and provide a steady glow of light thereto. The battery can be recharged using solar energy as well. The illuminating device can come in various symmetrical and asymmetrical shapes to be used around outlets, light switches and other areas that need to be illuminated for easy access. The illuminated device can be attached with a magnet, tape, adhesive, or hook and loop fasteners for easy application and installation.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
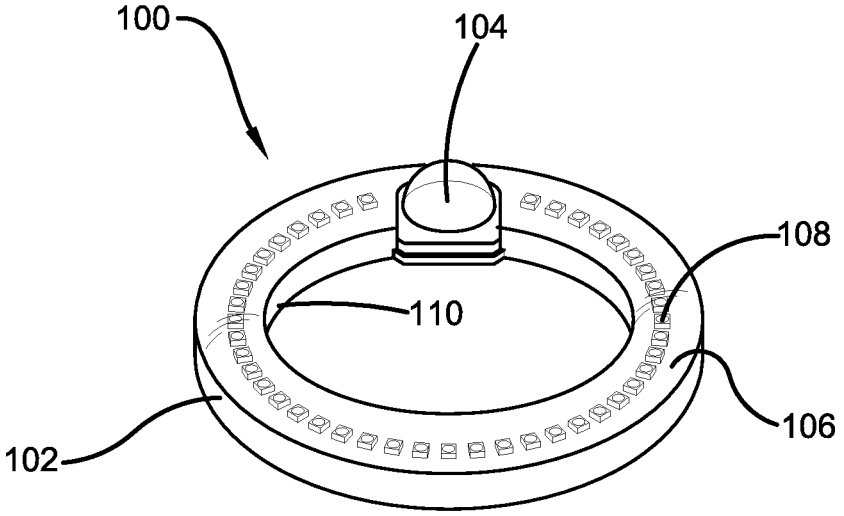
FIG. 1 illustrates a perspective view of one potential embodiment of the illuminated light source of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long felt need in the art for an improved source of light that provides illumination in various dark or dimly lit areas of a dwelling. There is also a long felt need in the art for an illuminated source of light that automatically illuminates dark areas at night. Additionally, there is a long felt need in the art for an illuminated source of light that provides focused lights for specific areas, such as door locks, door knobs, door handles and more. Moreover, there is a long felt need in the art for an illuminated source of light that ensures the door handle or lock is easily accessible by a user even in dark or dimly lit surroundings. Further, there is a long felt need in the art for an illuminated source of light that creates a sense of relief and security amongst individuals, particularly children, when entering a dark room at night. Furthermore, there is a long felt need in the art for an illuminated source of light that does not require user to find light switches or outlets to access a door at night. There is also a long felt need in the art for a light source that provides direct, targeted lighting for door locks, door handles, door knobs and more without being blocked by the individual attempting to access the door. Finally, there is a long felt need in the art for an illuminated source of light that focusses light on door handles, door knobs or other designated areas, is decorative in design and is convenient and secure for users.

The present invention, in one exemplary embodiment, is a novel illuminating light device designed to offer a steady, targeted beam of light to a desired area. The device is comprised of a main body having a groove in which a light source is placed, a motion sensor, a rechargeable battery to provide power to the motion sensor and the light source, a transparent sheath to cover the light source and adhesive tape at the bottom of the main body to adhere the smart illuminating light device to any surface, thereby allowing the light source to provide direct and/or indirect illumination to the desired area. When the motion sensor detects a motion or movement within a certain range, the light source is automatically turned ON. A timer circuit, with a pre-configured timer value, allows the light source to automatically turn OFF after said timer value has expired.

Referring initially to the drawings, FIG. 1 illustrates a perspective view of one potential embodiment of the illuminated light source of the present invention in accordance with the disclosed architecture. The illuminated light source 100 is a battery operated rechargeable light source having a general circular shape with LED lights 108 disposed in the form of a strip. The illuminated light source 100 has a main body including an outer surface 102 and an inner surface 110, wherein the outer surface 102 and the inner surface 110 are connected to a base to form an integrated single piece unit. A groove is formed between the outer surface 102 and the inner surface 110 in which the LED lights 108 are placed. The LED strip is covered by a dome lid 106 formed of a clear material such as a Polycarbonate (PC) material that allows for the transmission of LED illumination nearly in the same capacity as that of a glass cover.

The illuminated light source 100 has a motion sensor covered with a domed lid 104 that is connected to the LED lights 108, and is designed to turn ON the LED lights 108 automatically by sensing a movement within a pre-determined range. The pre-determined range can be programmed in advance via the motion sensor at the time of manufacturing. Alternatively, the range can be programmed using a smartphone application installed on a smartphone or tablet which is paired with the illuminated light source 100 through a wireless channel such as Wi-Fi/Bluetooth. For pairing with a smartphone or tablet, a wireless module is present in the illuminated light source 100 to provide wireless connection capabilities. In one embodiment, touching the strip of LED lights 108 can turn the LED lights ON and OFF or the LED lights can be turned OFF after a pre-configured time delay, programmed in the timer circuit, has expired.

At the base of the illuminated light source 100, an adhesive such as double-sided tape is affixed to adhere the illuminated light source 100 to a surface such as a door, wall, ceiling or any other desired location. Any other fasteners, such as a magnet or hook and loop fasteners can be used depending on the different types of mounting surfaces. The illuminated light source 100 comprises various shapes and sizes to be used around outlets, light switches, and other areas that need to be illuminated for easy, safe access.

Figure 2:
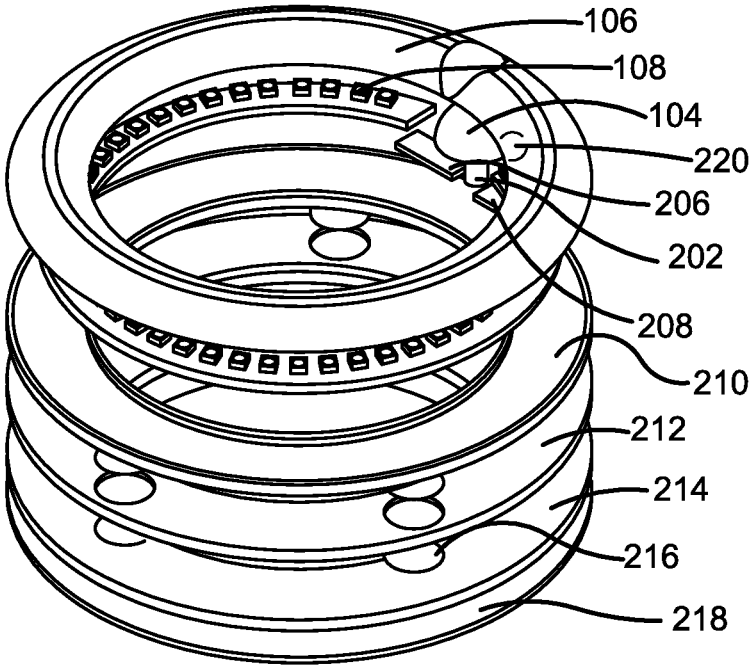
FIG. 2 illustrates an exploded perspective view of the components of one potential embodiment of the illuminated light source of the present invention in accordance with the disclosed architecture.

FIG. 2 illustrates an exploded perspective view of one potential embodiment of the components of the illuminated light source of the present invention in accordance with the disclosed architecture. As shown, the illuminated light source 100 has a layered structure with a dome lid 106 made up of clear Polycarbonate (PC) material that forms the top layer that covers the underlying LED lights 108. The Polycarbonate (PC) material dome lid 106 protects the LED lights 108 while providing highly effective light transmittance. The PC material of the LED cover lends itself for use with lower-powered sources of illumination such as LED lights because the material is translucent and will tend to give off a faint glow when there is a minor source of light at one or both ends of the material. The LED lights 108 are present in the form of a strip, generally circular in shape. In one preferred embodiment, the LED lights are present in a thirty-six LED light circuit with equal numbers of white LED lights and warm (yellow) LED lights. The LED lights are connected to an Li-Ion Battery 206 having voltage and current characteristics of 3.7 V-120 mAh.

The illuminated light source 100 comprises a motion sensor 202 covered with a lid 104 for protection. The motion sensor 202 enables the LED lights 108 to automatically turn ON if any movement is detected within a pre-determined range around the illuminated light source 100. A PCB assembly or controller 208 is present that contains the necessary circuitry for the motion sensor 202 and timer circuit. The PCB assembly or controller 208 comprises the machine-readable memory for storing instructions for execution of the required tasks.

The main body of the illuminated light source 100 has three layers comprised of a top layer 210, a middle layer 212 and a bottom layer 214. The layers are integrated to each other to form a single unit main body. The layers 210, 212, 214 can be manufactured using a thermoplastic polymer such as High Density Polyethylene (HDPE). The layers can be available in multiple color options such as cool gray, brown, yellow, black etc. to match to the décor and color of most door hardware. The layers 210, 212, 214 may be attached and integrated to each other using a fastener such as a neodymium magnet 216 made of steel. A plurality of neodymium magnets 216 can be used to attach the layers 210, 212, 214 to each other to form the integrated main body.

At the bottom of the illuminated light source 100, a fastener 218, such as a double-sided tape, is present to adhere the illuminated light source 100 to a desired surface. Instead of double-sided tape, any other fastener such as a magnet or hook and loop fasteners may be used to adhere the illuminated light source to the desired location.

The illuminated light source 100 may also comprise a micro-USB charging port 220 to recharge the battery 206. An associated charging cord also comes with the illuminated light source 100 to facilitate charging of the battery 206.

It should be appreciated that the illuminated light source 100 comprises other shapes, such as rectangular or square, to be used for door handles and deadbolts with a square base. The illuminated light source comprises flexible material that may be bent into a variety of asymmetrical shapes to accommodate any configuration of hardware. Magnetic fasteners on a mounting surface can be used to easily attach the illuminated light source 100 to a refrigerator, oven, or other magnetic source in, for example, a dark or dimly lit kitchen.

The motion sensor used in the present invention includes a range of generally about six feet. The LED lights connected to the motion sensor stay in sleep mode until the motion sensor detects a motion, which instantly turns ON the LEDs. The sleep mode helps to save battery life. In another embodiment, the range of the motion sensor can be up to ten feet.

Figure 3:
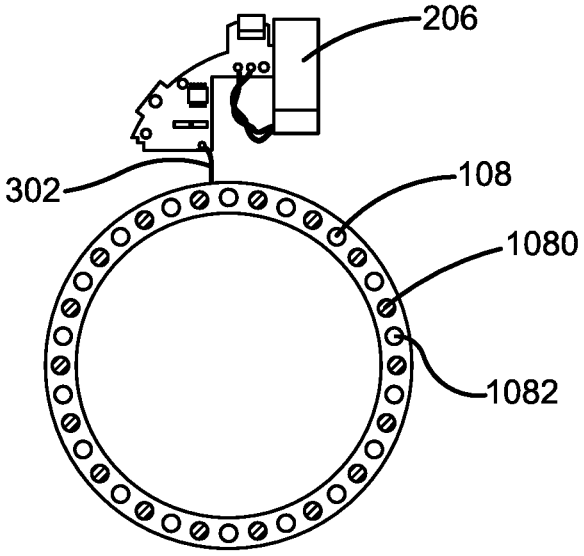
FIG. 3 illustrates a perspective view of the LED light bulbs of one potential embodiment of the illuminated light source of the present invention in accordance with the disclosed architecture.

FIG. 3 illustrates a perspective view of one potential embodiment of the LED lights used in the illuminated light source of the present invention in accordance with the disclosed architecture. As shown, the LED lights 108 comprise non-white (i.e. warm) LED lights 1080 and white LED lights 1082 in the form of a strip. The LEDs are powered by a battery 206 connected through a wired mechanism 302. As stated earlier, the battery 206 is rechargeable via a micro-USB charging port.

The LED lights are present in the form of an LED strip with a waterproof covering suited for outside environments. In one preferred embodiment, the illuminated light source 100 has a thirty-six LED light circuit with eighteen white LED lights 1082 and eighteen non-white LED lights 1080 wherein each LED light is equidistant to another. The mix of white and non-white (i.e. warm) LEDs provide a bright illuminated area around the light source 100.

In one embodiment of the present invention, the brightness of the LED lights can be adjusted using a control button present in the illuminated light source 100 or wirelessly through a control via the smartphone application installed on a paired smartphone or tablet. It should be appreciated that LED lights of different combinations or other colors can also be made available in the illuminated light source 100. The LED light source, while turned on, forms a ring around the edge of the doorknob to increase the aesthetic appeal of their appearance.

Figure 4:
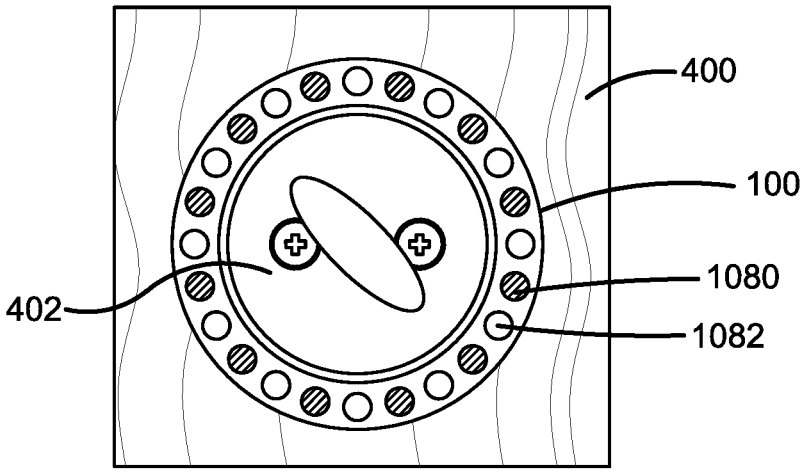
FIG. 4 illustrates a perspective view of the illuminated light source of one potential embodiment of the present invention in accordance with the disclosed architecture, wherein the illuminating device is mounted adjacent to a door entry deadbolt.

FIG. 4 illustrates a perspective view of one potential embodiment of the illuminated light source 200 of the present invention mounted directly to a door around an entry handle and/or deadbolt lock in accordance with the disclosed architecture. As shown, the illuminated light source 100 is attached directly to a door 400 around a deadbolt/lock 402. An adhesive at the back of the illuminated light source 100 is used for attaching the illuminated light source 100 to the door 402. During use, the warm LED lights 1080 and the white LED lights 1082 are turned on manually or turned on automatically by a motion detector.

Figure 5:
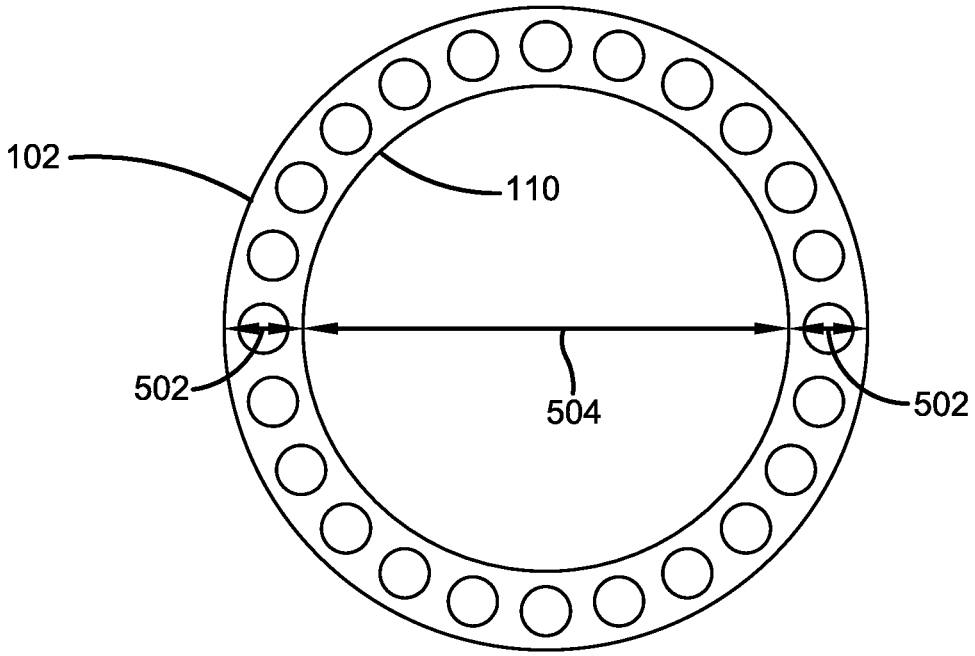
FIG. 5 illustrates a perspective view of the illuminated light source of one potential embodiment of the illuminated light source of the present invention in accordance with the disclosed architecture, wherein relative dimensions are displayed.

FIG. 5. illustrates a perspective view of another illustrative embodiment of the present invention in accordance with the disclosed architecture. In a preferred embodiment, the inner diameter 504 across the inner surface 110 of the main body is approximately 6-7 cm, and the LED strip has a uniform width 502 of between 1.5-1.9 cm. The total diameter of the illuminated light source 100 is preferably between 9-11 cm. Nonetheless, based on the size and illumination requirements, the dimensions of the illuminated light source 100 can be more or less than the dimensions of the present embodiment. The motion detector/sensor is also circular in shape and has a diameter of 1 cm in one embodiment to keep the size both compact and lightweight. The illuminated light source 500 can have three layers comprised of a top layer 510, a middle layer 512 and a bottom layer 514. The layers are integrated to each other to form a single unit main body. The layers 510, 512, 514 can be manufactured using a thermoplastic polymer such as Low Density Polyethylene (LDPE). LDPE is easy to process and mold into any desired shape. LDPE also provides for a flexible material that can be bent to any desired outline or geometric shape. LDPE possesses good electrical insulation and waterproof properties desirable for outdoor applications. Additionally, LDPE can be processed as transparent, due to its amorphous properties, to facilitate effective light transmittance. The layers of the light source 500 can be available in multiple color options such as black, cool gray, brown, yellow etc. to match or complement the décor and color of the door hardware. The layers 510, 512, 514 may be attached/integrated to each other using a fastener such as a neodymium magnet 516 made of steel. A plurality of neodymium magnets 516 can be used to attach the layers 510, 512, 514 to each other to form the integrated main body.

At the bottom of the illuminated light source 500, a fastener 518 such as a double-sided tape is present to adhere the illuminated light source 500 to the desired surface. Instead of double-sided tape, any other fastener such as a magnet or hook and loop combination may be used to adhere the light source 500 to the desired surface.

The illuminated light source 500 also has a micro-USB charging port 520 to recharge the battery 506. An associated charging cord also comes with the illuminated light source 500 to facilitate charging of the battery 506. It should be appreciated that the illuminated light source 500 accommodates asymmetrical mounting for door handles and respective hardware having odd-shaped outlines. Further, the light source 500 can be processed and molded in a linear arrangement (i.e. as a "rope"). The linear rope, during installation, can be selectively shortened in order to customize the length for installation adjacent to any variety of hardware geometries, angles and shapes. Magnetic, adhesive and hook and loop fasteners can be used to easily attach the illuminated light source 500 on or adjacent to a door's hardware.

Figure 6:
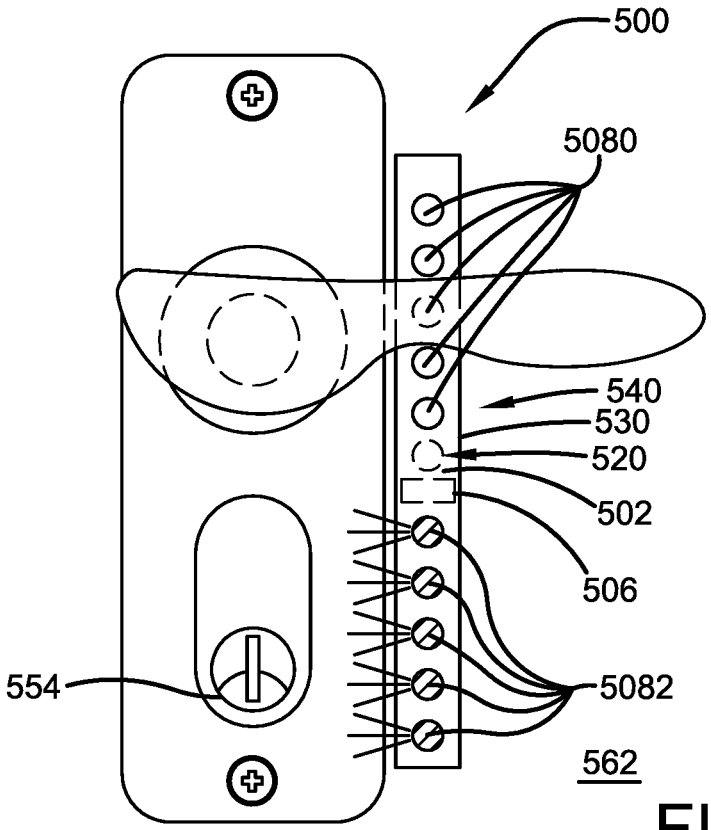
FIG. 6 illustrates a perspective view of the illuminated light source of one potential embodiment of the present invention in accordance with the disclosed architecture, wherein the illuminating device is mounted asymmetrically to a door lock.

FIG. 6. illustrates a perspective view of another illustrative embodiment of the present invention in accordance with the disclosed architecture. As described above, an illuminated light source 500 can have three layers comprised of a top layer, a middle layer and a bottom layer 514 (not illustrated). The layers are integrated to each other to form a single unit main body. The layers can be manufactured using a thermoplastic polymer such as Low Density Polyethylene (LDPE). LDPE is easy to process and mold into any desired shape. LDPE also provides for a flexible material that can be bent to any desired outline or geometric shape. LDPE possesses good electrical insulation and waterproof properties, rendering it desirable for outdoor applications. Additionally, LDPE can be processed as transparent, due to its amorphous properties, to facilitate light transmittance. The layers of the light source 500 can be available in multiple color options such as black, cool gray, brown, yellow etc. to match or complement the décor and finish of the door hardware. The layers may be attached/integrated to each other using a fastener such as a neodymium magnet made of steel. A plurality of neodymium magnets can be used to attach the layers to each other to form the integrated main body (not illustrated).

At the bottom of the illuminated light source 500, a fastener such as double-sided tape can be present to adhere the illuminated light source 500 to the desired surface. Instead of double-sided tape, any other fastener such as a magnet or hook and loop combination may be used to adhere the light source to the surface.

The illuminated light source 500 also has a micro-USB charging port 520 to recharge the battery 506. An associated charging cord also comes with the illuminated light source 500 to facilitate charging of the battery 506. It should be appreciated that the illuminated light source 500 accommodates asymmetrical mounting for door handles and respective hardware having odd-shaped outlines. Further, the light source 500 can be processed and molded in a linear arrangement 530 (i.e. as a "rope"). The linear rope, during installation, can be selectively shortened in order to customize the length for installation adjacent to any variety of hardware geometries, angles and shapes. Magnetic, adhesive and hook and loop fasteners can be used to easily attach the illuminated light source 500 on, or adjacent to, a door's hardware.

As shown in FIG. 6, the light source 500 can be bent and maneuvered into any variety of shapes and curves in accordance with the disclosed architecture. As shown, LED lights 540 can comprise non-white or warm LED lights 5080 and white LED lights 5082 in a linear arrangement. The LED lights are powered by a battery 506 connected through a wired mechanism 502. As stated earlier, the battery 506 can be rechargeable via a micro-USB charging port. The wired mechanism can be mounted central to the light source 500. The warm LED lights 5080 can be on one side of the wired mechanism 502, while the other LED lights 5082, for example white LED lights, can be on the other opposing side of the wired mechanism 502. The length or number of respective light circuit LED lights 5080, 5082, can be adjusted by the installer to accommodate directed desired illumination at the door hardware and indirect desired illumination around the door area. LED lights 5082 can be mounted to target the preferred amount of light 550 directly at, for example, a door lock 554 to facilitate key entry while shielding an individual's eyes from direct light. Directing the light 550 towards the door lock can be facilitated by the use of a shield 560. As described, the illumination can be customized to be asymmetrical and/or non-uniform from a reference source point (i.e. mechanism 502). The LED lights 5080 can be mounted to provide general illumination around, for example, the door lock and handle. In this manner, directed light 550 can be targeted to a specific position on the door without interfering with the vision of the individual approaching and standing over the door handle/door lock to gain access to the dwelling.

Figure 7:
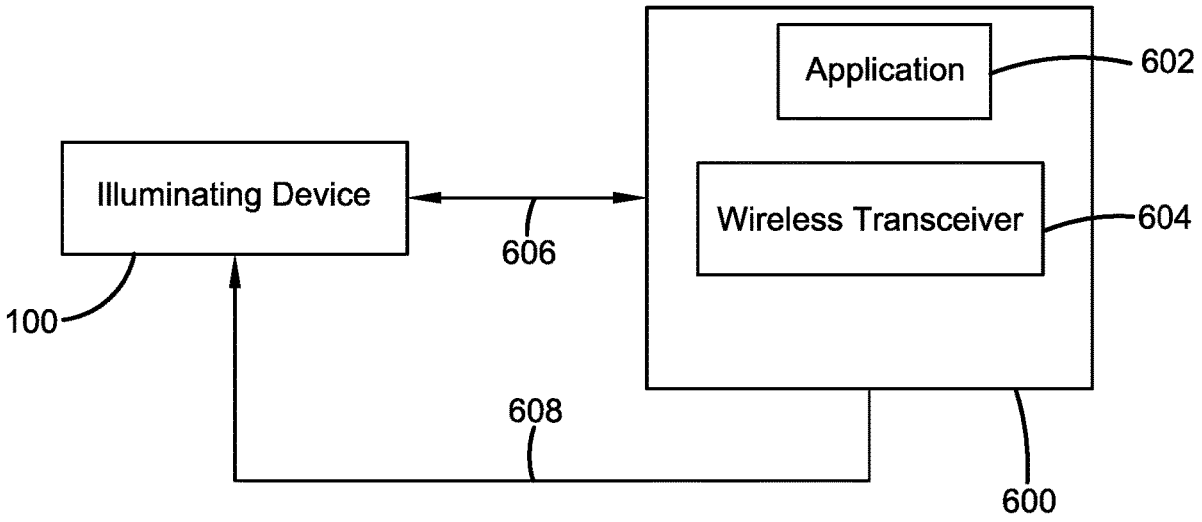
FIG. 7 illustrates a flow diagram of one potential embodiment of the method of using one potential embodiment of the illuminated light source of the present invention with a smartphone application installed on a smartphone or tablet in accordance with the disclosed architecture.

FIG. 7 illustrates a flow diagram of one potential embodiment of the method of using one potential embodiment of the wireless connection of the illuminated light source 500 including a smartphone application installed on a smartphone or tablet in accordance with the disclosed architecture. In the present embodiment, the illuminated light source 100 has a wireless module using a companion smartphone application 602 installed on a smartphone 600 or tablet. Using a wireless transceiver 604, the application 602 is paired with the illuminated light source 100 using a wireless channel 606 of a technology such as Bluetooth/Wi-Fi/NFC/RF-ID. After pairing, the smartphone application 602 can configure parameters such as the brightness of the LED lights, color of LEDs, and/or the range of the motion sensor of the illuminated light source 100. It should be noted that the configuration of any component can be controlled and modified via the parameters of the smartphone application 602 using wireless instruction 608.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "illuminating light device", "smart illuminating light device", "light source", and "illuminated source of light" are interchangeable and refer to the illuminating light device 100, 500 of the present invention.

Notwithstanding the forgoing, the illuminating light device 100, 500 of the present invention can be of any suitable size and configuration as is known in the art without affecting the overall concept of the invention, provided that it accomplishes the above-stated objectives. One of ordinary skill in the art will appreciate that the size, configuration and material of the illuminating light device 100, 500 as shown in the FIGS. are for illustrative purposes only, and that many other sizes and shapes of the illuminating light device 100, 500 are well within the scope of the present disclosure. Although the dimensions of the illuminating light device 100, 500 are important design parameters for user convenience, the illuminating light device 100, 500 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An illumination device configured to provide illumination for a portion of a door, the illumination device comprising:

a base comprising a top layer, a middle layer, and a lower layer attached to each other via a plurality of neodymium magnets positioned between the layers to form an integrated base;

an illuminating portion having an outer surface and a translucent dome lid covering the outer surface, the outer surface secured to and extending from the top layer of the base;

an attachment mechanism for magnetically mounting the lower layer of the base to the door;

a motion sensor attached to an inner circumference of the outer surface of the illumination portion encapsulated with a domed lid; and wherein said outer surface comprises a strip of LED light bulbs encapsulated between the outer surface and the translucent dome lid; and wherein said strip of LED light bulbs comprises a first series of lights directly illuminating a particular portion of the door and a second series of lights indirectly illuminating another portion of the door.

2. The illumination device of claim 1, wherein said first series of lights comprises white LED light bulbs and said second series of lights comprises non-white LED light bulbs.

3. The illumination device of claim 2 further comprising a controller in electrical communication with the motion sensor for sensing a motion and activating said strip of LED light bulbs.

4. The illumination device of claim 3, further comprising a Bluetooth module for wireless communication with a remote device.

5. The illumination device of claim 4, further comprising a battery for powering said illumination device.

6. The illumination device of claim 5, wherein said battery is rechargeable.

7. The illumination device of claim 2, wherein each of said translucent dome lid and said strip of LED light bulbs comprise a flexible LDPE material.

8. An illumination device configured to provide illumination to a door entry hardware, the illumination device comprising:

a base comprising a top layer, a middle layer, and a lower layer attached to each other via a plurality of neodymium magnets positioned between the layers to form an integrated base;

an illuminating portion having an outer surface secured to and extending from the top layer of the base, wherein said outer surface comprises a transparent dome lid covering a strip of LED light bulbs, and further wherein said strip of LED light bulbs comprise a first series of bulbs with a first illumination and a second series of bulbs with a second illumination, the first and second illuminations being asymmetrical about the door entry hardware; and a motion sensor attached to an inner circumference of the outer surface of the illumination portion encapsulated with a domed lid; and an attachment mechanism for mounting the lower layer of the base to the door entry hardware, wherein said attachment mechanism is selected from a group consisting of a magnet and a hook and loop fastener; and wherein the first and second illuminations are shielded from a user's eyes.

9. The illumination device of claim 8, wherein said first illumination is directly illuminating a particular portion of the door entry hardware and the second illumination is indirectly illuminating another portion of the door entry hardware.

10. The illumination device of claim 9, wherein each of said transparent dome lid, said strip of LED light bulbs, and said attachment mechanism comprises a flexible material for asymmetrical mounting about the door entry hardware.

11. The illumination device of claim 10, wherein said first series of bulbs comprises white LED light bulbs and said second series of bulbs comprises non-white LED light bulbs.

12. The illumination device of claim 11 further comprising a controller in electrical communication with the motion sensor for sensing a motion and activating said strip of LED light bulbs.

13. The illumination device of claim 12 further comprising a Bluetooth module in wireless communication with a remote device.

14. The illumination device of claim 13 further comprising a battery for powering said illumination device.

15. The illumination device of claim 14, wherein said battery is rechargeable.

* * * * *